US008881441B2

(12) United States Patent
Thornton

(10) Patent No.: US 8,881,441 B2
(45) Date of Patent: Nov. 11, 2014

(54) MEDALLION DISPLAY CASE

(71) Applicant: Terry G. Thornton, Ballwin, MO (US)

(72) Inventor: Terry G. Thornton, Ballwin, MO (US)

( * ) Notice: Subject to any disclaimer, the term of this patent is extended or adjusted under 35 U.S.C. 154(b) by 0 days.

(21) Appl. No.: 14/140,684

(22) Filed: Dec. 26, 2013

(65) Prior Publication Data

US 2014/0212602 A1 Jul. 31, 2014

Related U.S. Application Data

(60) Provisional application No. 61/849,624, filed on Jan. 31, 2013.

(51) Int. Cl.
*A47G 1/06* (2006.01)
*A47G 1/12* (2006.01)

(52) U.S. Cl.
CPC ..... *A47G 1/12* (2013.01)
USPC ..... 40/723; 40/724; 40/743; 206/6.1

(58) Field of Classification Search
CPC ..... A47G 1/12; A45C 11/16
USPC ..... 40/722, 723, 724, 743; 206/6.1
See application file for complete search history.

(56) References Cited

U.S. PATENT DOCUMENTS

| | | | | |
|---|---|---|---|---|
| 1,365,388 | A | 1/1921 | Ede | |
| 1,455,143 | A | 5/1923 | Maurer | |
| 2,804,659 | A * | 9/1957 | Smith | 52/78 |
| 3,134,484 | A | 5/1964 | Cox | |
| 3,451,180 | A * | 6/1969 | Struben | 52/478 |
| 3,782,558 | A | 1/1974 | Schael | |
| 3,792,543 | A | 2/1974 | Powell | |
| 4,559,728 | A * | 12/1985 | Price | 40/124.2 |
| 5,118,171 | A | 6/1992 | Ortiz | |
| 5,253,750 | A | 10/1993 | Keffer | |
| D366,796 | S | 2/1996 | Crowley | |
| 5,782,022 | A | 7/1998 | Tubberville | |
| 6,283,278 | B1 | 9/2001 | Holztrager | |
| 6,328,171 | B1 | 12/2001 | Coppel | |
| 6,793,297 | B2 * | 9/2004 | Johnson et al. | 312/114 |
| 7,325,339 | B2 | 2/2008 | Jordan | |
| 7,396,054 | B2 * | 7/2008 | Carrier | 292/75 |
| 7,731,023 | B1 | 6/2010 | Lesch | |
| D629,203 | S | 12/2010 | Sayre | |
| 7,987,988 | B2 | 8/2011 | Johnson | |
| 8,091,716 | B2 | 1/2012 | Bair | |
| 8,356,433 | B2 | 1/2013 | Babbitt | |
| 2002/0145365 | A1 * | 10/2002 | Johnson et al. | 312/114 |
| 2006/0278347 | A1 * | 12/2006 | Jonson | 160/168.1 R |
| 2007/0131634 | A1 | 6/2007 | Markle | |
| 2010/0236115 | A1 * | 9/2010 | Gaetano | 40/598 |
| 2012/0043864 | A1 | 2/2012 | Brandes | |
| 2012/0234506 | A1 * | 9/2012 | Defenbaugh et al. | 160/168.1 R |
| 2013/0134111 | A1 | 5/2013 | Florek | |

* cited by examiner

*Primary Examiner* — Gary Hoge
(74) *Attorney, Agent, or Firm* — CreatiVenture Law; Linda L Lewis

(57) ABSTRACT

A display case housing a display board for displaying a variety of differently sized medal articles and their ribbon widths, where the display board is constructed of a plurality of rectangular chip-board or other like material slats, horizontally arranged, where each is over-lapped in stepped fashion, the lower edge of the first slat extending in front of the top edge of the second slat; where the outer edges of the overlapped slats are fixed in place; where the medallions are inserted through a vertical slot from the backside of the display-mounting board, positioned as preferred, and are displayed on the front side of the display board.

19 Claims, 7 Drawing Sheets

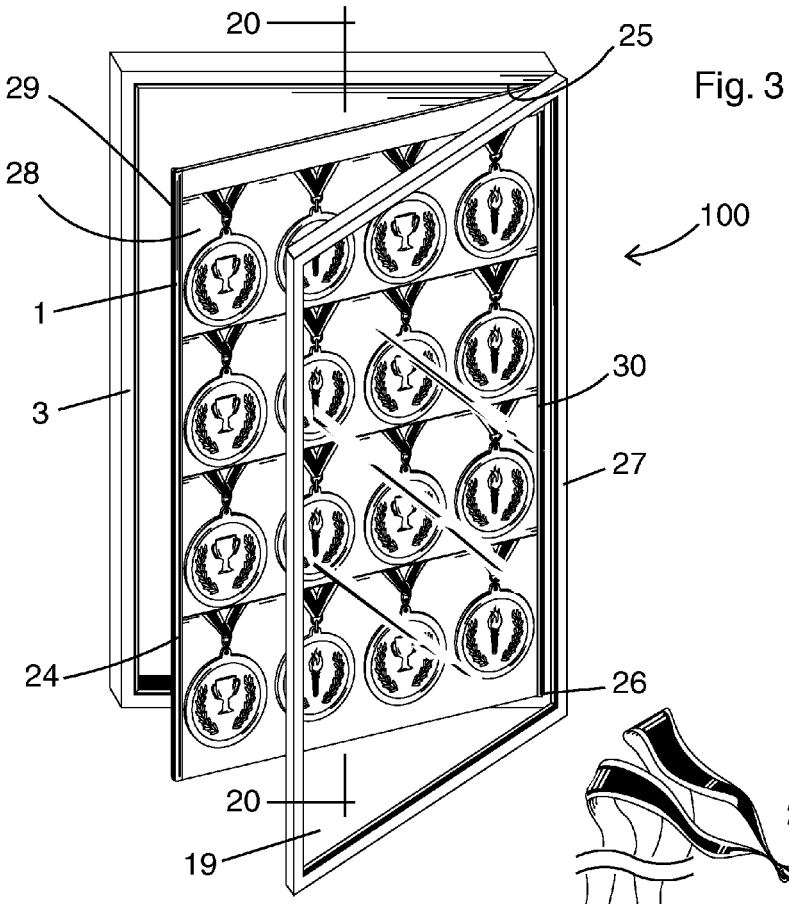
Fig. 3
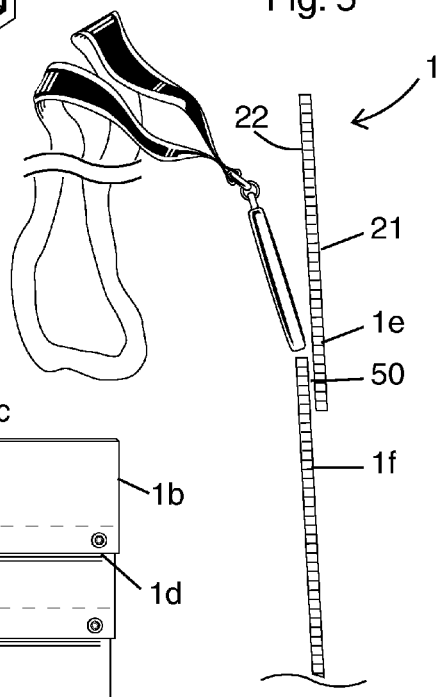
Fig. 5
Fig. 4
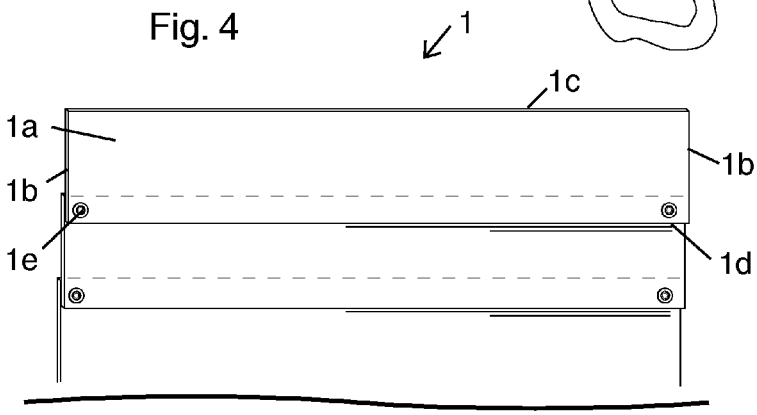

Fig. 10a
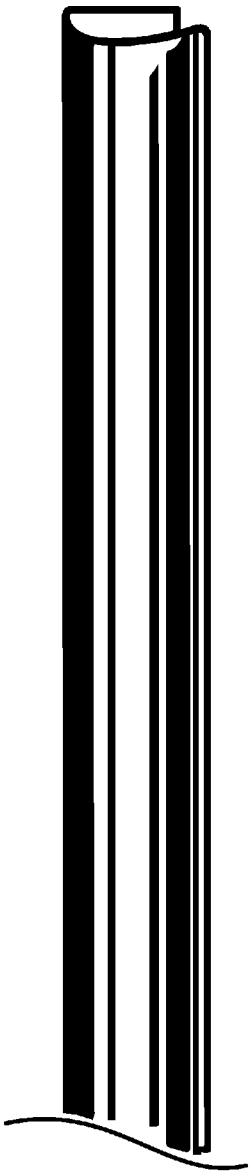
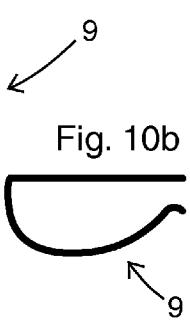
Fig. 10b
Fig. 11a
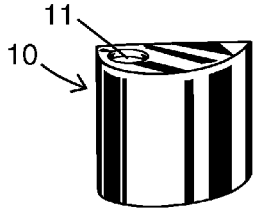
Fig. 11c
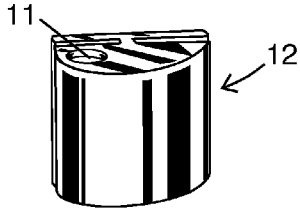
Fig. 11b
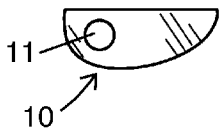
Fig. 11d
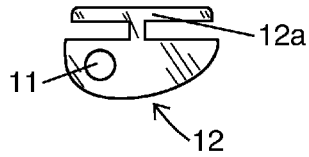
Fig. 12a
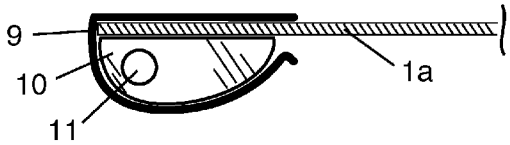
Fig. 12b
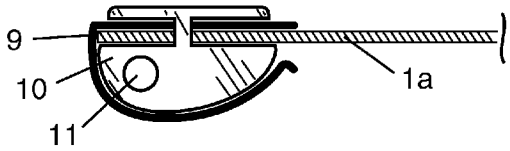
Fig. 13a
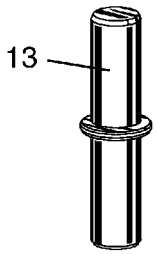
Fig. 13b
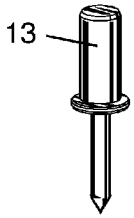
Fig. 13c
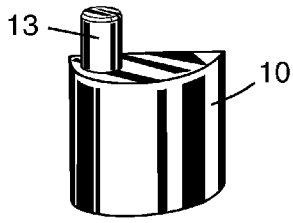

MEDALLION DISPLAY CASE

CROSS-REFERENCE TO RELATED APPLICATIONS

This application claims the benefit of U.S. Provisional Patent Application No. 61/849,624 filed Feb. 27, 2013, which is hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

This invention relates to devices that house and showcase award medals where the medal is suspended from a length of decorative ribbon e.g., medallions, which are often ceremoniously placed over the head to wear around the neck. This invention offers an effective and simple device on which to arrange and affix a number of medallions of this type, in a variety of sizes, on a mounting display board, and to display them collectively as an aesthetic grouping of medallions for long-term appreciation and adequate preservation.

2. Related Art

There are numerous display cases known in the art designed to house and display medallions or other slightly raised dimensional items. A number of display cases are picture frame adaptations designed with greater frame depth, often referred to as "shadow boxes" to allow for the inclusion of raised dimensional items for display. U.S. Pat. No. 7,987,988 discloses a transparent cube-shaped display case to hang medallions by their ribbons. US 2002/0145365 discloses a display case for medals and their ribbons, where ribbons are inserted through horizontal slots of uniform size. This fixed display limits the size and types of ribbons and medals that can be displayed. US 2013/0134111 discloses a display board using pegs to display medallions. None of the above has the flexibility to arrange and secure a plurality of medallions varying in size, weight, and ribbon width, with facile device access means, and a quick and simple use process.

For purposes of developing an understanding of the preferred functionality of the device, the basic application includes: accessing and then mounting a number of individual medals into an internal mounting chip-board material display-mounting board, where each medal is inserted through strategically fabricated slats in the display board, along with enough ribbon also passing through the slat to allow the medal to hang down on the front side of the display-mounting board for visibility, and a means to separately secure the medal ribbon on the back side of the display board. Any extra ribbon on the back side of the display board can be stored. The finalized display board is contained in a glass front display case, which is ready to be displayed.

This invention is an improvement from the prior art as a uniquely designed, singular and integrated system. It provides a combined, flexible support of a variety of sized medallions, and simple mounting and display of the medallions.

This invention provides a way to mount, display and accommodate a full variety of the more difficult-to-display medallions. It can also be used to display jewelry, key-chains or other suspended items.

This display case device provides a useful and appealing means to quickly and artfully arrange, secure and display a variety of neck-worn award medals within an encased container.

SUMMARY OF THE INVENTION

An embodiment of the present invention is a display board comprising a first slat and a second slat; where the first and second slats are approximately rectangular and horizontal; wherein each slat has a slat front and a slat back, a top edge and a bottom edge and two side edges; wherein the first slat is positioned above the second slat; wherein the bottom edge of the first slat overlaps the top edge of the second slat; wherein the bottom edge of the first slat rests on the front of the second slat, and the top edge of the second slat rests on the back of the first slat; wherein the horizontal overlap creates a vertical slot; and wherein the side edges of the slats are held fixedly by a slat fastener.

Another embodiment of the present invention is a display case comprising a display casing and a display board; wherein the display board comprises a first slat and a second slat; where the first and second slats are approximately rectangular and horizontal; wherein each slat has a slat front and a slat back, a top edge and a bottom edge and two side edges; wherein the first slat is positioned above the above slat; wherein the bottom edge of the first slat overlaps the top edge of the second slat; wherein the bottom edge of the first slat rests on the front of the second slat, and the top edge of the second slat rests on the back of the first slat; wherein the horizontal overlap creates a vertical slot; and wherein the side edges of the slats are held fixedly by a slat fastener; wherein the display casing has a door; wherein the door has a transparent opening; wherein the door is rotatably attached to the display casing; and wherein the display board fits inside the display casing. The general objective of this invention is to provide a singular and fully integrated system for securing a variety of neck-worn medals into a display case container.

BRIEF DESCRIPTION OF THE DRAWINGS

FIG. 3 is front perspective view of the display case showing the second opened position of the display case and the display board.

FIG. 4 is a front perspective partial section view of the display board.

FIG. 5 is a vertical side partial cross section view of the display board and a side view of a medallion with a ribbon showing the insertion of medallion into the vertical slot.

FIG. 10*a* is a vertical perspective partial view of the display board U-channel fastener.

FIG. 10*b* is a top plan view of the U-channel fastener.

FIG. 11*a* is a vertical perspective close-up view of a U-channel insert.

FIG. 11*b* is a top plan view of an embodiment of a U-channel insert.

FIG. 11*c* is a top plan view of another embodiment of a U-channel insert.

FIG. 11*d* is a top plan view of the alternate U-channel insert.

FIG. 12*a* is a partial section close-up top plan view of the display board, with an embodiment of a U-edge channel applied to a mounting board vertical edge, with the inserted channel insert.

FIG. 12*b* is a partial section close-up top plan view of the display board, with another embodiment of a U-edge channel applied to a mounting board vertical edge, with the inserted channel insert.

FIGS. 13*a*, 13*b* and 13*c* are a close-up vertical perspective views of different embodiments of pivot hinge pins.

Figure 1:
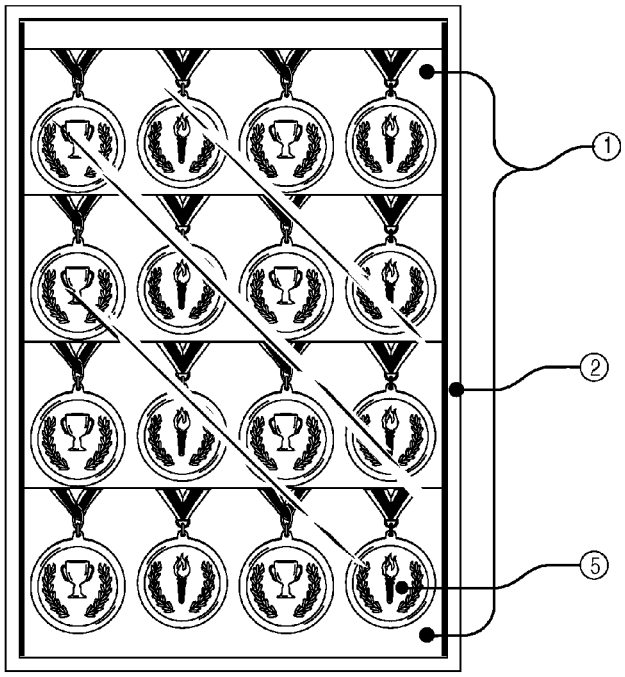
FIG. 1 is an elevation front view of the display case in a closed position.

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The general objective of this invention is to provide a singular and fully integrated system for securing a variety of neck-worn medals into a display case container.

It is a principle object of the device be configured with a uniquely designed display board, constructed of a plurality of rectangular chip-board or other like material slats, horizontally arranged, where each is over-lapped in stepped fashion, the lower edge of the first slat extending in front of the top edge of the second slat. The outer edges of the overlapped slats are fixed in place. This device provides a solution for displaying a variety of differently sized medal articles and their ribbon widths. The medallions are inserted through a vertical slot from the backside of the display-mounting board, positioned as preferred, and are displayed on the front side of the board.

The slats can be made from a variety of synthetic or natural materials, such as card stock, cardboard, wood, plastic, composites, etc. It is important that the materials have sufficient strength to support the weight of the medallions being mounted, while being thin enough to be used in a flat display. It is also important that the materials have some resilience, as the slats must have some flex as the medallions are being inserted through the vertical slots, yet resume their flat configuration.

The slats can be of a variety of dimensions from 1 to 100 inches or more in length or width. Preferably, they are at least 1 inch wide, so that there is room for the slats to overlap, at least 0.25 inch. Preferably, the slats overlap at least 0.5 inch or more. This provides room for the clip to hold the ribbon in place to attach without being visible from the front of the display board.

In addition to the first and second slats, additional slats can be added below the second slat. The number of slats is only limited by the dimensions of the display case. In a typical display case, in addition to the first and second slats are third and fourth slats. In an embodiment, there are from 2 to 100 slats. In a preferred embodiment there are from 2 to 10 slats.

It is also a principle object of this device where the outer display case is sufficient in depth to house the ancillary length of ribbon on the back of the mounting board, and also sufficient depth on the front side of the case as to allow the thickness of the medal medallions being displayed.

It is also a principle object of the display case to have a front door casement which frames glass or other transparent material. The casement is affixed to the display case by way of pivoting means, such as hinges secured on one edge of the structure. Preferably, the hinge is placed longitudinally on one front vertical edge of the display case structure. However, the pivoting means can be along the top or bottom of the structure. With a center axis now longitudinally established on the one vertical edge, the framed glass front can then be opened or closed approximately 45 degrees along a semi-circular path and horizontal plane. This structure now allows frontal access to the display board when mounting medallions. After mounting, the articles are protectively encased and viewable through the glass.

The display casing and the casement enclosing the window are preferably made of wood, plastic or composite that can be decoratively painted or stained. The casing and casement must have sufficient strength to support the display and medallions.

It is also a principle object of the device be configured where, the display board is completed with a structural edge channel, as example, a plastic extruded U-shaped channel around the vertical side edges of the slats of the display board, providing additional support and aesthetic finishing. The edge channel allows the mounting board to be hinged into the inner longitudinal side of the display case frame, with the center axis longitudinally established on the one vertical side. It allows the mounting board to pivot freely about the axis along approximately a 45 degree path and horizontal plane. The hinged display board provides access to the front and the back of the mounting board for easy access.

It is an additional object within the mounting process, that the method to completely secure a medallion on the display board includes the use of clip fasteners, such as, plastic extruded U-shaped channel clip fasteners that are applied from the back of the display board, and affixed with the open-end down over the ribbon folded over the top edge of a mounting board slat and the top edge of the slat.

It is an additional object with the ribbon securing clips, that the clips are engineered so that the gap of the open channel is of sufficient resilience to frictionally secure the ribbon onto a top slat top edge, and hold and secure the medal in place, yet be easily attachable and detachable. It is also desirable that no the ribbon is not damaged by the clip. The clip height should not be such where the clip is viewable from the displayed front side of the mounting board.

It is an additional object, that the ancillary medal ribbon length on the back side of the display board can be gathered together as a loose bundle and placed into a containment embodiment, such as a cardboard pocket, a pouch of stretchable cloth or other material, on the lower back edge of the display board.

It is an additional objective that the display case is so designed so that it is convenient to access the display board within the display casing, and the process of securing any variety of medallions is single end-to-end simple procedure, is reliable requires no extraordinary skill to complete the mounting of objects.

It is an additional intent that, with the display case can be displayed through conventional fastening means as a wall-hung display case, and can be easily accessed while hung.

It is also an additional objective that the device can be comprised of many variations. It is easy to then contemplate a number of embodiments to the display container dimensions, shape, materials and ornamentation, the variety of mounting board materials, dimensions and plurality of slats, medal ribbon securing devices, the versions of solutions to the movable components and features, and overall construction methods. This description provides satisfactory variation as to the breadth of possible product interpretations, their manufacturer and the consumer uses and desires for extended applications.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

The following description of the preferred embodiment(s) is merely exemplary in nature and is in no way intended to limit the invention, its application, or uses. Referring now to the drawing FIG. 1, an elevation front view of the display case 100 of the invention in the closed position, showing a display board 1 with medallions 5 in their final affixed position, within the display casing 3, and enclosed behind a framed glass front door 2.

Figure 2:
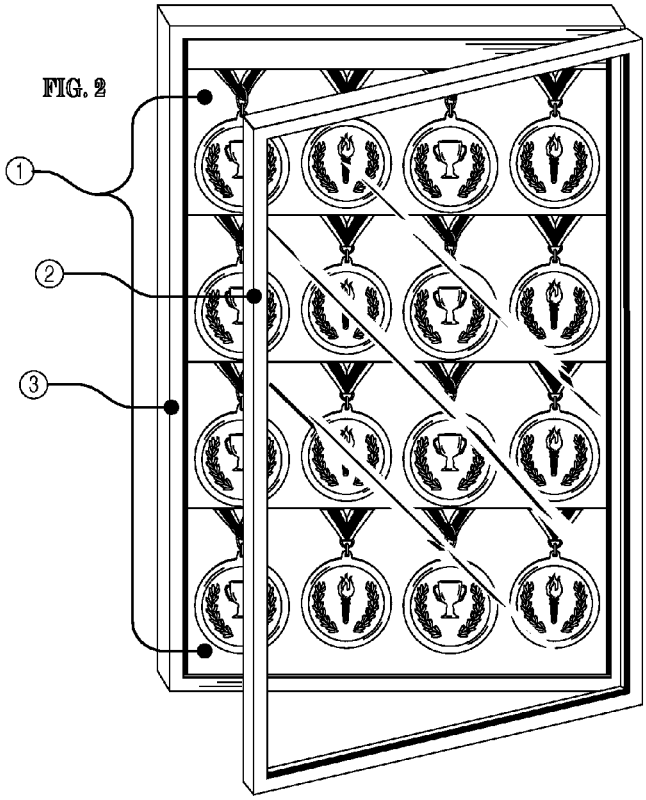
FIG. 2 is a front perspective view of the display case showing the first opened positions of the display case glass door.

FIG. 2 is front perspective view of the display case 100 in the opened position with the door 2, consisting of a structural frame and transparent opening 19 made of glass, plastic pane or other transparent material, which is hinged on one vertical side, allowing the door when opened, to permit access to the internal display-mounting board assembly 1, which is positioned within the display container casing 3.

FIG. 3 is a front perspective view of the display case 100 showing the open position of the internal display board 1 which is hinged on one vertical side 30, and which when opened, allows the ability to access both the front of the display board 28 and the back of the display board 29 as needed during medallion placement.

Figure 15:
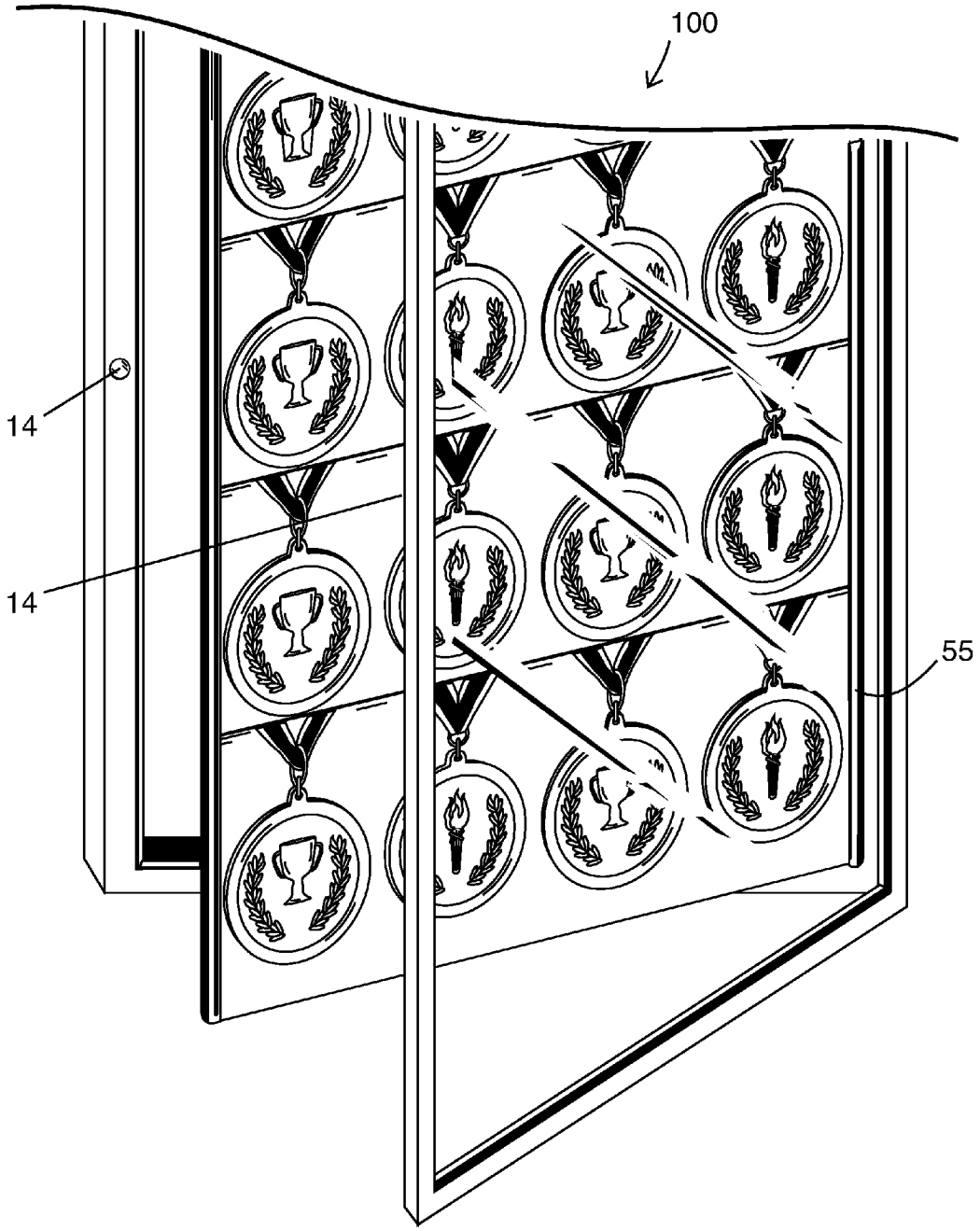
FIG. 15 is a partial section front perspective front view of the display case with magnetic door fasteners.

FIG. 4 is a front perspective partial section view of the display board, showing at least two flat rectangular slats 1*a*, fabricated from card-stock, decorative velvet flocked cardboard, plastic sheet or other material in sufficient thickness and stiffness, arranged with an edge overlap along the horizontal lengths in a manner where, one bottom edge 1*d* of the top slat is placed in front of the slat below it on the top edge 1*c* of the lower slat. In this downward and cascaded arrangement, the slats are secured together in this configuration just along the overlain corners 1*e*, by way of conventional riveting, stapling, gluing or other relevant processes. The edges of the slats 1*b* are fixedly secured as shown in FIG. 15. The display board provides the novel obscured vertical slot 50.

FIG. 5 is a vertical side partial section view of the display board taken along lines 20-20 in FIG. 3, shows how each medallion 5 is inserted between the first and second slats 1*e* and 1*f*, by way of gentle pressure to flex the slats and press each medallion 5 through the slot 50, and then to secure the medallion by its ribbon on the back side of the display board 1 with ribbon securing clip 6.

Figure 6:
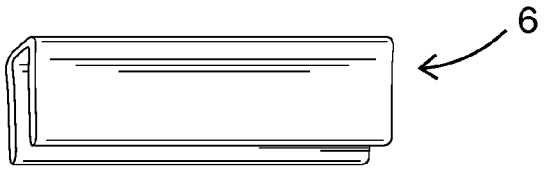
FIG. 6 is a front perspective view of a ribbon securing clip.

FIG. 6 is a front perspective view of a ribbon securing clip 6, fabricated through conventional plastic molding, machined metal or other material shaping processes, so designed to be semi-rigid, flexible, resilient and of dimensions and tolerance to frictionally secure the width of ribbon on the top edge of a slat on the back of the mounting board 1, thereby supporting the weight of the medal.

Figure 7:
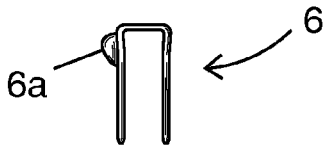
FIG. 7 is a vertical side view of an embodiment of the ribbon securing clip.

FIG. 7 is a vertical side view of the ribbon securing clip 6, showing another embodiment having a small grasping handle 6*a*, to facilitate the grasping of the clip with the index finger and thumb during the application of the mounting clip onto ribbon and mounting board slat edge.

Figure 8:
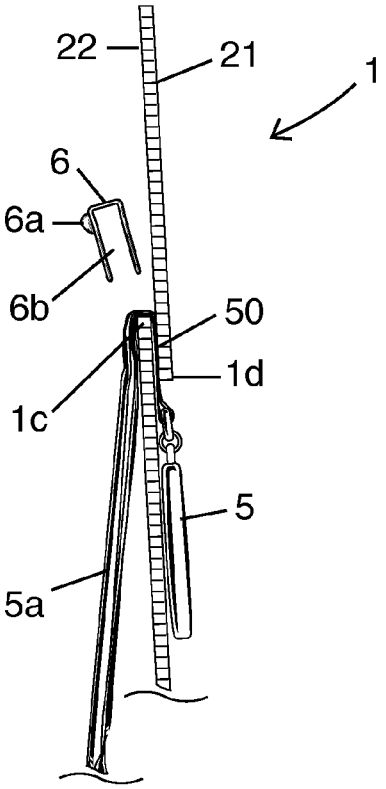
FIG. 8 is a vertical side partial cross section view of the display board and side view of a ribbon mounting clip showing the application of the ribbon mounting clip to hold a medallion.

FIG. 8 is a vertical side sectional view of the display-mounting board 1, taken along lines 20-20 in FIG. 3, in which inserted medallions 5 are secured with a mounting clip 6. As medallions are inserted through mounting board slats from the slat back 22 to slat front 21, the ribbon 59 on the back 22 and is folded downward over the top edge 1*c* of the slat. A ribbon securing clip 6 is positioned above the ribbon 5*a* with the open bottom channel 6*b* down, and with gentle pressure, the ribbon securing clip is slid downward directly over the layer of ribbon and top edge 1*c* to frictionally bind the ribbon 5*a* onto the top edge, resulting in a final securing of the medallion 5.

Figure 9:
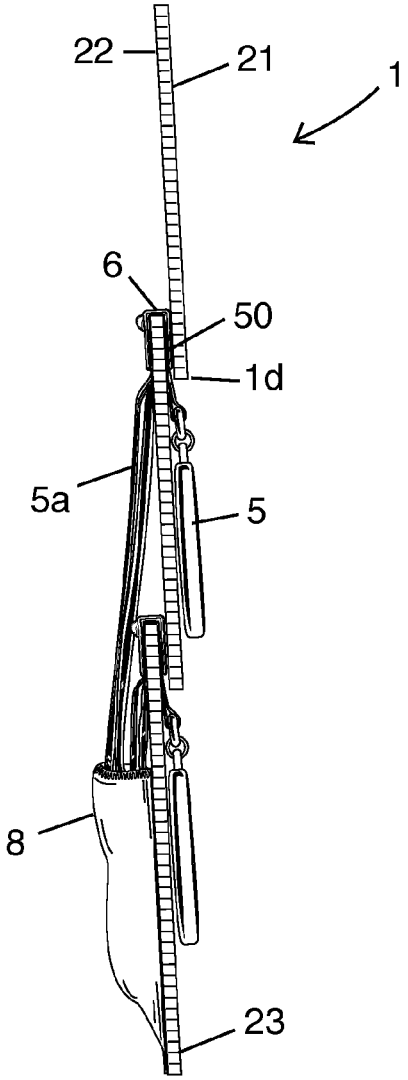
FIG. 9 is vertical side partial cross section view of the display board showing secured medallion, with the ancillary ribbon gathered and secured at the base of the display board with a pouch.

FIG. 9 is vertical side partial cross section view of the display board showing where the ancillary ribbon 5*a* can be gathered and secured in place by an elastic material pouch 8, at the base 23 of the back of the mounting board 1. Alternate ribbon containment embodiments include elastic ribbon, netting, a cardstock door, pocket and other apparatuses.

FIG. 10*a* is directed to the display board hinge mechanism. A close-up perspective partial section view of an embodiment of a fabricated U-channel fastener 9. FIG. 10*b* is a view of the channel fastener 9 profile. The channel fastener 9 is preferably made by way of common plastic extrusion process. The unique profile shape shown in top plan view FIG. 10*b* and internal channel dimensions accommodate both the vertical edge portion of the display-mounting board and channel inserts 10. An appropriate length of the edge channel fastener 9 is first applied to the display-mounting board vertical side edges during assembly for a finished edge appearance. The fastener subsequently houses the channel inserts which prepare one vertical display board edge to serve as the hinging axis.

FIG. 11*a* is a vertical perspective close-up view of an example custom U-channel insert 10, and top plan view is shown in FIG. 11*b*. A vertical perspective close of up of alternate edge channel insert 12 is shown in FIG. 11*c*, and top plan view is shown in FIG. 11*d*. The U-channel insert is preferably made by way of common plastic extrusion or die molding. The U-channel inserts 10 and 12 serve as an end plug and hinge component, where one channel insert each is inserted into the two ends of the display board edge channel along the vertical sides of the display board. The U-channel inserts are of sufficient tolerance to be frictionally held in place, or secured by way of conventional gluing, riveting, stapling, welding or other relevant processes. The U-channel insert has a vertical cylindrical cavity 11 that can accommodate a hinge pivot pin 13. FIGS. 11*b* and 11*d* show the unique edge channel insert profile and cylindrical cavity 11. FIG. 11*c* shows T-channel insert 12.

FIG. 12*a* is a partial section close-up top plan view of the final display-mounting board assembly 1, with the U-channel 9 applied to a mounting board vertical edge 24, along with the inserted channel insert 10. FIG. 12*b* shows T-channel insert 12 with corresponding vertical notches in both the top edge of the display-mounting board assembly and U-channel now accept the corresponding T-channel portion of the edge channel insert, and when inserted, is of sufficient tolerance to frictionally hold and secure the display board edge, U-channel and U-channel insert together.

FIGS. 13*a*, 13*b* and 13*c* are close-up perspective views of pivot hinge pin 13, where each is affixed vertically into the horizontal upper 24 and also lower 26 corners of the internal planes of display casing frame. The pivot hinge pins orient and ultimately secure the display board hinge edge 55 into the display casing. The pin design includes variations in securing into final position, such as, insertion into a corresponding receiving cylindrical cavity in the inner case frame locations, or whereas the pin in FIG. 13*b* is designed with one end having a pointed spike sub-part, allowing the pin to be press fit into the required locations, or optionally as shown in design FIG. 13*c*, where the pin is a fixed part of the U-channel insert.

Figure 14A:
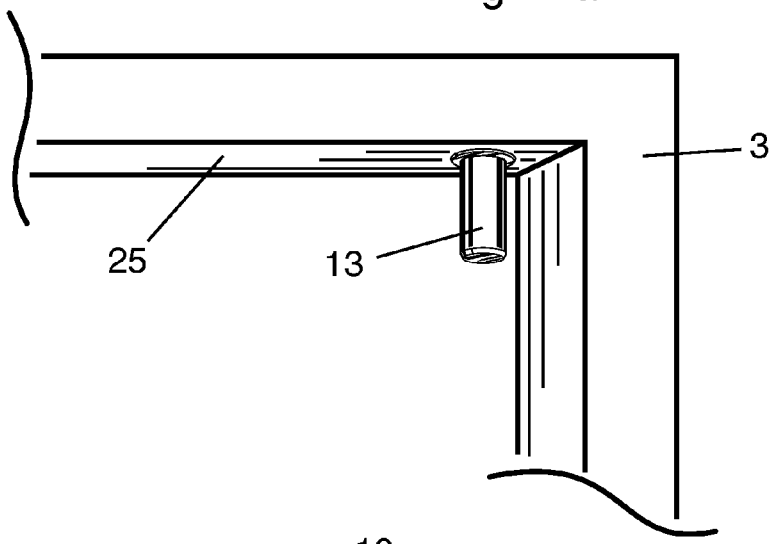
FIG. 14*a* is a partial section close-up front perspective view of the pivot hinge pin secured in the upper internal frame corner location of the display container casing.
Figure 14B:
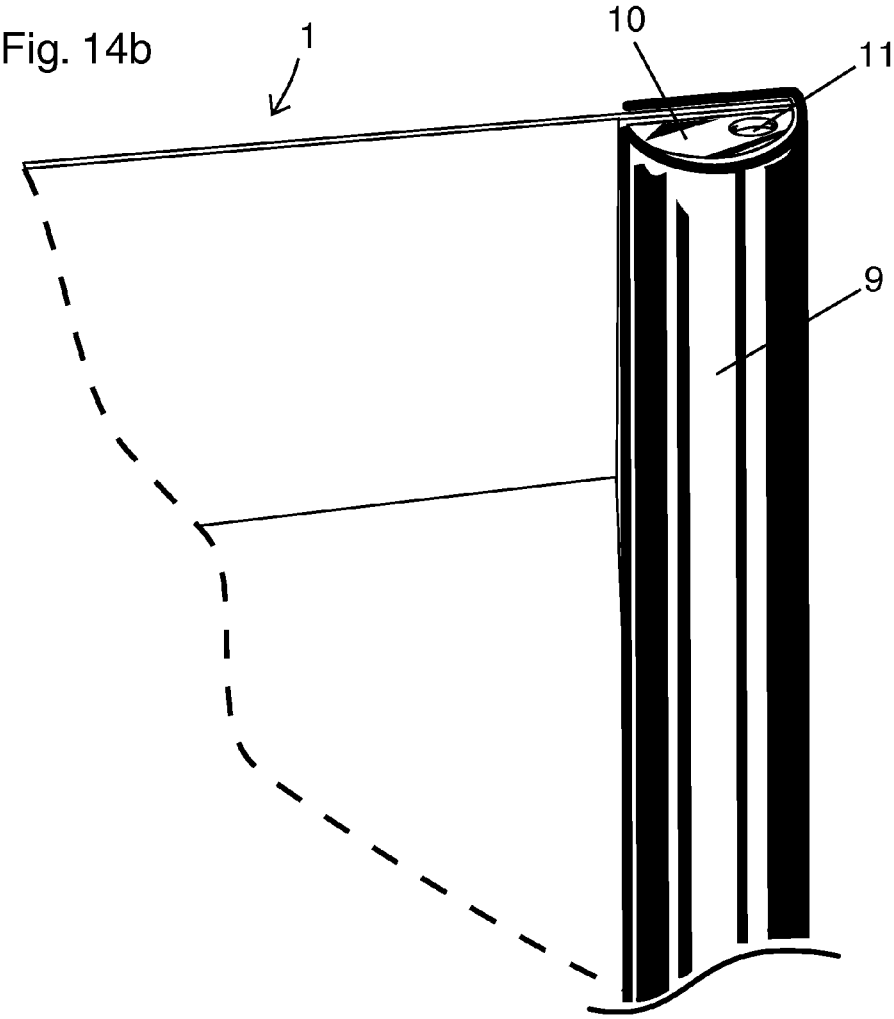
FIG. 14*b* is a sectional close-up front perspective view of the display-mounting board assembly with the U-channel, the U-channel insert, and the cylindrical cavity.

FIG. 14*a* shows a close-up partial section perspective view of the hinge pin 13 secured in the example upper internal frame 25 of the display container casing 3, and in FIG. 14*b*, a close-up sectional view of the display board 1, which secures internally into the display casing frame by way of the channel insert 10 and cylindrical cavity 11 that correspond and insert onto the pivot pin 13, where the first is positioned in the upper internal frame 25 and the second is positioned in the lower internal frame corner 26 along one vertical internal edge axis 27 of the display container casing. To position the mounting board onto the affixed frame pins, the resilience in the display board and edge channel materials allow for a flexing and returning to the original straight position of the display board edge to create the necessary space to affix one corner of the mounting board edge onto the first pin, and flexing inserting the second pin. The display case 100 allows the pivoting of the display board.

FIG. 15 is a partial section front perspective view of the display case 100 showing an embodiment of magnetic fasteners 14 for door 2. Optionally, similar or the same fasteners can be used with the display board.

Figure 16:
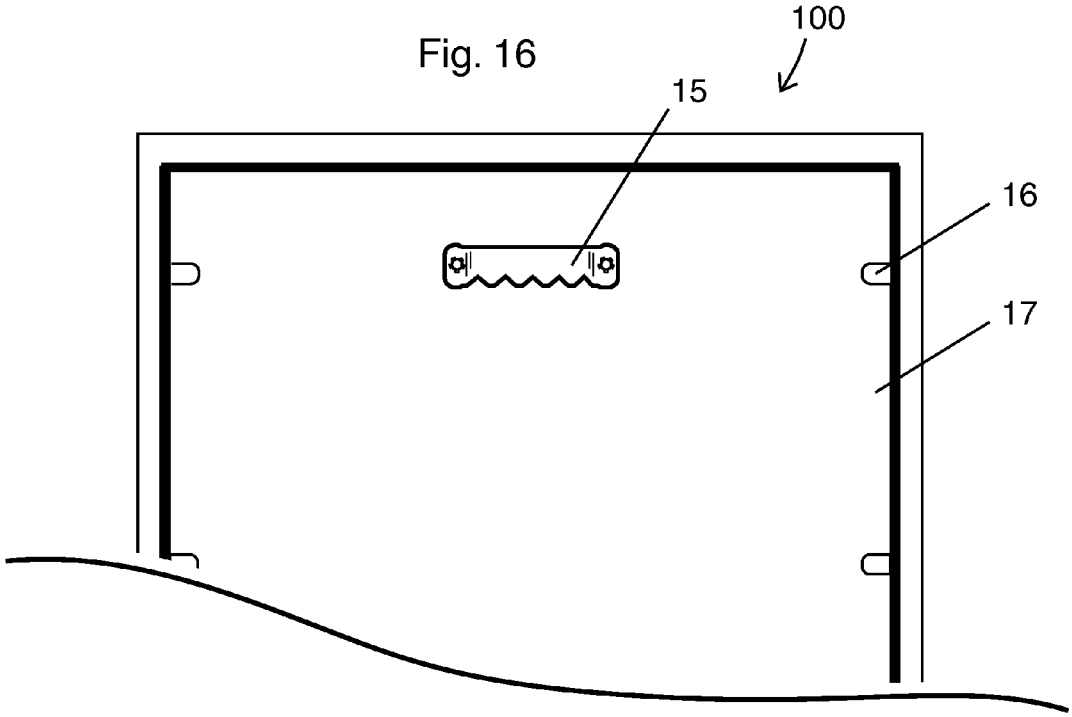
FIG. 16 shows a partial section elevation back view of the display case with wall hanging hardware.

FIG. 16 shows a partial section elevation back view of display case 100 of an embodiment of the present invention having an applied conventional case backing having a backing board 17 with backing board fasterners 16 and hanging hardware 15.

Figure 17:
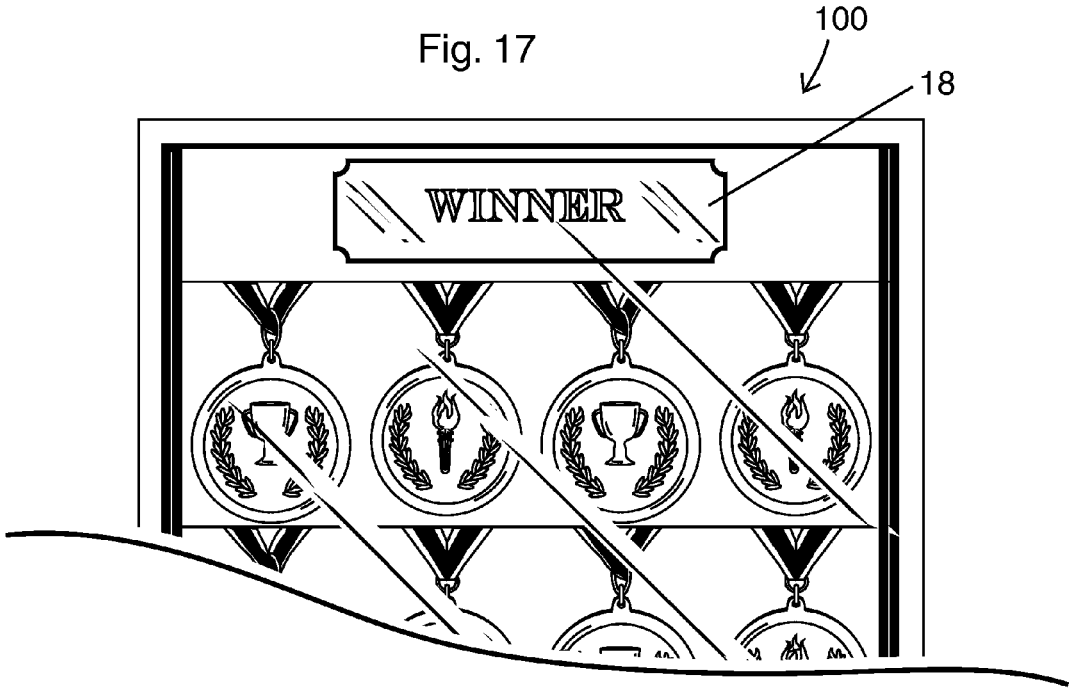
FIG. 17 shows a partial section elevation front view of the display case with a name-plate attached.

FIG. 17 shows a partial section elevation front view of display case 100 of an embodiment having a name-plate 18 attached.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A display board comprising a first slat and a second slat;
wherein the first and second slats are approximately rectangular and horizontal;
wherein each slat has a slat front and a slat back, a top edge and a bottom edge and two side edges;
wherein the first slat is positioned above the second slat;
wherein the bottom edge of the first slat overlaps the top edge of the second slat;
wherein the bottom edge of the first slat rests on the front of the second slat, and the top edge of the second slat rests on the back of the first slat;
wherein the horizontal overlap creates a vertical slot;
wherein the two side edges of the slats are held together immovably by two slat fasteners;
wherein the display board has a display casing;
wherein there are additional slats positioned below the second slat;
wherein the display board fits inside the display casing;
wherein the display casing has a door with an opening with a transparent cover;
wherein there are from 2 to 10 slats; and
wherein the slat fasteners are U-channel fasteners.

2. The display board of claim 1, wherein the slat fasteners have a channel insert on each end of the fasteners.

3. The display board of claim 2, wherein the board is rotatably attached to the display casing by means of two pivot hinge pins inserted into the channel inserts.

4. The display case of claim 1, wherein the slat fasteners have a channel insert on each end of the fasteners.

5. The display case of claim 4, wherein the board is rotatably attached to the display casing by means of two pivot hinge pins inserted into the channel inserts.

6. The display case of claim 4, wherein the display board has from 2 to 10 slats.

7. A display case comprising a display casing and a display board;
wherein the display board comprises a first slat and a second slat;
where the first and second slats are approximately rectangular and horizontal;
wherein each slat has a slat front and a slat back, a top edge and a bottom edge and two side edges;
wherein the first slat is positioned above the second slat;
wherein the bottom edge of the first slat overlaps the top edge of the second slat;
wherein the bottom edge of the first slat rests on the front of the second slat, and the top edge of the second slat rests on the back of the first slat;
wherein the horizontal overlap creates a vertical slot; and
wherein the two side edges of the slats are held together immovably by two slat fasteners;
wherein the display casing has a door;
wherein the door has an opening with a transparent cover;
wherein the door is rotatably attached to the display casing; and wherein the display board fits inside the display casing;
wherein the slat fasteners are U-channel fasteners;
wherein the slat fasteners have a channel insert on each end of the fasteners; and
wherein the board is rotatably attached to the display casing by means of two pivot hinge pins inserted into the channel inserts.

8. The display case of claim 7, wherein inserted into the vertical slot is at least one medallion with a ribbon which is displayed on the front of the second slat.

9. The display case of claim 8, wherein the ribbon of the at least one medallion is fastened to the top edge of the second slat with a clip.

10. The display case of claim 9, wherein the clip has a handle.

11. The display case of claim 10, wherein the back of the display is a pouch for ribbon.

12. The display case of claim 11, wherein multiple medallions of varying sizes and shapes are displayed.

13. A display board comprising a first slat and a second slat;

wherein the first and second slats are approximately rectangular and horizontal;

wherein each slat has a slat front and a slat back, a top edge and a bottom edge and two side edges;

wherein the first slat is positioned above the second slat;

wherein the bottom edge of the first slat overlaps the top edge of the second slat;

wherein the bottom edge of the first slat rests on the front of the second slat, and the top edge of the second slat rests on the back of the first slat;

wherein the horizontal overlap creates a vertical slot;

wherein the two side edges of the slats are held together immovably relative to each other by two slat fasteners; and wherein the slats are held in a flat position relative to each other.

14. The display board of claim 13 further comprising a display casing.

15. The display board of claim 14, wherein there are additional slats positioned below the second slat.

16. The display board of claim 15, wherein the display board fits inside the display casing.

17. The display board of claim 16, wherein the display casing has a door with an opening with a transparent cover.

18. The display board of claim 17, wherein there are from 2 to 10 slats.

19. The display board of claim 18, wherein the slat fasteners are U-channel fasteners.

* * * * *